US005107932A

United States Patent [19]

Zachman et al.

[11] Patent Number: 5,107,932

[45] Date of Patent: Apr. 28, 1992

[54] METHOD AND APPARATUS FOR CONTROLLING THE BLADE OF A MOTORGRADER

[75] Inventors: Mark E. Zachman, Troy; Michael H. Kidwell, Huber Heights, both of Ohio

[73] Assignee: Spectra-Physics Laserplane, Inc., Dayton, Ohio

[21] Appl. No.: 662,952

[22] Filed: Mar. 1, 1991

[51] Int. Cl.[5] ..... E02F 3/84

[52] U.S. Cl. ..... 172/4.5; 172/789; 172/1; 180/136

[58] Field of Search ..... 172/1, 45, 789, 2, 751; 37/DIG. 1, DIG. 14, DIG. 20; 180/136

[56] References Cited

U.S. PATENT DOCUMENTS

| | | | |
|---|---|---|---|
| 2,754,499 | 7/1956 | Jost . | |
| 2,886,299 | 5/1959 | Heimaster et al. . | |
| 3,250,547 | 5/1966 | Myers . | |
| 3,786,871 | 1/1974 | Long et al. | 172/4.5 |
| 3,791,452 | 2/1974 | Long et al. | 172/4.5 |
| 3,833,928 | 9/1974 | Gavit et al. | 340/52 R |
| 3,947,839 | 3/1976 | Zigmant | 340/282 |
| 4,008,466 | 2/1977 | Smith | 340/282 |
| 4,081,033 | 3/1978 | Bulger et al. | 172/4.5 |
| 4,122,390 | 10/1978 | Kollitz et al. | 324/65 R |
| 4,156,466 | 5/1979 | Caldwell | 172/4.5 |
| 4,213,503 | 7/1980 | Elmberg et al. | 172/4.5 |
| 4,431,060 | 2/1984 | Scholl et al. | 172/4.5 |
| 4,465,292 | 8/1984 | Fry et al. | 280/95 R |
| 4,545,439 | 10/1985 | Sellett et al. | 172/430 |
| 4,696,486 | 9/1987 | Ruhter | 280/400 |
| 4,914,593 | 4/1990 | Middleton et al. | 364/424.07 |
| 4,918,608 | 4/1990 | Middleton et al. | 364/424.07 |
| 4,924,374 | 5/1990 | Middleton et al. | 364/167.01 |
| 4,926,948 | 5/1990 | Davidson | 172/4.5 |

FOREIGN PATENT DOCUMENTS

| | | | |
|---|---|---|---|
| 3610666 | 10/1987 | Fed. Rep. of Germany | 37/DIG. 1 |
| 0173231 | 10/1983 | Japan | 172/4.5 |
| 173232 | 10/1983 | Japan | 172/4.5 |
| 0055925 | 3/1984 | Japan | 172/4.5 |
| 102023 | 6/1984 | Japan | 172/4.5 |
| 0130832 | 6/1988 | Japan | 37/DIG. 1 |

OTHER PUBLICATIONS

"CAT Automatic Blade Control", Brochure, Caterpillar Tractor Co., Oct. 1979.

*Primary Examiner*—Randolph A. Reese
*Assistant Examiner*—Jeffrey L. Thompson
*Attorney, Agent, or Firm*—Killworth, Gottman, Hagan & Schaeff

[57] ABSTRACT

A method and apparatus are disclosed for controlling the cross slope angle cut by the blade of an articulated frame motorgrader being steered through a turn, operated in a straight frame mode, in a crabbed steering position and/or traveling in a non-horizontal plane. The blade angle is sensed and controlled such that the sensed blade angle is maintained substantially equal to a calculated blade angle. In a first embodiment, the blade angle calculation is performed using the equation: tan $BS=(\sin \tau')(\tan R)+(\cos \tau')(\tan CS)$ where BS is the required blade slope angle of said blade relative to horizontal; $\tau'$ is a rotational angle of the blade with respect to the blade's direction of travel projected into horizontal; R is an angle between the blade's direction of travel and horizontal; and CS is the desired cross slope angle which is entered by an operator of the motorgrader. In a further embodiment, the blade angle calculation is performed using the equation: tan $BS=(\sin \tau'')(\tan R')+(\cos \tau'')(\tan CS)$ where BS is the required blade slope angle of the blade relative to horizontal; R'' is the rotational angle of the blade with respect to the blade's direction of travel projected into horizontal with the lateral slope angle of the front steering unit set equal to zero; R' is an angle between horizontal and the direction of travel of the blade with the lateral slope angle of the front steering unit set equal to zero; and CS is the desired cross slope angle.

21 Claims, 6 Drawing Sheets

METHOD AND APPARATUS FOR CONTROLLING THE BLADE OF A MOTORGRADER

BACKGROUND OF THE INVENTION

The present invention relates generally to a motorgrader having a two-part articulated frame defined by a rear drive unit and a front steering unit which can be rotated or pivoted relative to the drive unit and, more particularly, to an improved method and apparatus for controlling the cross slope angle cut by such a motorgrader while the motorgrader is making a turn and/or is traveling in a steep slope condition.

It is important to be able to grade surfaces during the construction of roadbeds, runways, parking lots and the like so that the grade and cross slope, i.e., the slope normal to the direction of travel of the motorgrader's blade, closely approximate the finished surface. In this way, the pavement is of a uniform thickness and strength. Highly skilled motorgrader operators can perform grading operations manually to produce acceptable grades and cross slopes. However, due to time pressures and the inherent risk of error in manually producing grades and cross slopes, automatic control systems have been developed to assist operators and reduce the time and skill required to obtain acceptable grading.

One system, which is disclosed in U.S. Pat. No. 4,926,948 and is owned by the assignee of the present invention, permits a motorgrader operator to preset the slope of the blade and maintain that slope even when the motorgrader is being operated in a "crabbed" steering position. While this system is a substantial improvement over previously available slope preset systems, it is not capable of maintaining the accuracy of the cut when the motorgrader is making a turn. The reason for this relates back to the fact that cross slope is defined as the slope normal to the direction of travel of the blade. When the motorgrader is making a turn, the blade normally has a direction of travel that differs from the direction of travel of the remaining portions of the motorgrader. This control system, however, does not take into consideration the blade's specific direction of travel when the motorgrader is turning. Thus, this system is not able to accurately control the cut of the blade when the motorgrader is making a turn.

While motorgraders normally travel in a relatively horizontal plane during operation, there are situations when a motorgrader is operated in a steep slope condition. For example, a motorgrader might be operated on a side slope or could be driven up or down a steep hill. The system disclosed in U.S. Pat. No. 4,926,948 does not totally correct for errors occurring when the motorgrader is not traveling in a horizontal plane. This is because cross slope is referenced to gravity, yet the rotational angle sensors disclosed in U.S. Pat. No. 4,926,948 are referenced to the mainframe of the motorgrader, which does not always operate in a horizontal plane. While such errors are normally insignificant, they can become problematic if the motorgrader is operated on a steep hill or side slope.

Accordingly, there is a need for an improved method and apparatus for operating a motorgrader having a two-part articulated frame to maintain a desired cross slope when the motorgrader is making a turn and when the motorgrader is operated in a steep slope condition.

SUMMARY OF THE INVENTION

This need is met by the method and apparatus of the present invention for controlling the cross slope angle cut by the blade of an articulated frame motorgrader. The blade slope angle required to maintain a selected cross slope angle is calculated and the blade slope is then controlled so that the sensed blade slope angle is substantially equal to the calculated blade slope angle. The method and apparatus of the present invention is capable of maintaining the desired cross slope even when the motorgrader is steered through a turn and/or is operated in a steep slope condition.

In accordance with a first aspect of the present invention, apparatus is provided for controlling the cross slope angle of a surface being worked by a motorgrader having a two-part articulated frame defined by a rear drive unit including rear drive wheels and a front steering unit which can be rotated relative to the drive unit and including front steering wheels. A blade is supported upon the steering unit for rotation about a generally vertical axis with the blade being mounted for adjustment of the elevations of its ends to define a blade slope angle relative to horizontal. The apparatus comprises: input means for selecting a desired cross slope angle; first angle sensor means for sensing the angle of rotation of the blade relative to the steering unit; second angle sensor means for sensing the angle of rotation of the steering unit relative to the drive unit; and third angle sensor means for sensing the angle of rotation of the front steering wheels relative to the steering unit. First slope sensor means sense the blade slope angle of the blade relative to horizontal and second slope sensor means sense the longitudinal and lateral slope angles of the front steering unit relative to horizontal. Cross slope control means are connected to the input means, to the first, second and third angle sensor means, and to the first and second slope sensor means for controlling the blade slope angle to maintain the desired cross slope when the motorgrader is being steered through a turn.

The motorgrader preferably includes a circle unit connected to the steering unit. The blade is mounted on the circle unit and the first angle sensor means is located at a center pivot point of the circle unit. The second angle sensor means is mounted at an articulation joint interconnecting the steering unit to the drive unit. The third angle sensor means is mounted adjacent and coupled to the front steering wheels. The second slope sensor means preferably comprises first and second slope sensors.

The blade slope angle required to maintain the desired cross slope may be calculated by the cross slope control means using the equation:

$$\tan BS = (\sin \tau')(\tan R) + (\cos \tau')(\tan CS)$$

where BS is the required blade slope angle of the blade relative to horizontal; $\tau'$ is a rotational angle of the blade with respect to the blade's direction of travel projected into horizontal; R is an angle between the blade's direction of travel and horizontal; and CS is the desired cross slope angle. The cross slope control means then controls the blade slope so that the sensed blade slope angle is substantially equal to the calculated blade slope angle to maintain the desired cross slope when the motorgrader is operating in all modes including being steered through a turn.

The cross slope control means preferably calculates an angle between the front steering unit and the direction of travel of the blade by solving the following equation:

$$\beta = \tan^{-1}\left[\frac{\tan W(XY + AX \cdot \cos\alpha - AB \cdot \sin\alpha \cdot \cot W)}{AB \cdot \cos\alpha + AX \cos\alpha + XY}\right]$$

where $\mu$ is the angle between the front steering unit and the direction of travel of the blade; W is the angle of rotation of the front steering wheels relative to the steering unit; XY is equal to the distance between the articulation joint and a center point between the rear wheels; AX is equal to the distance between the articulation joint and a center point on the blade; AB is equal to the distance from a center point between the front wheels and the center point on the blade; and $\alpha$ is equal to the angle of rotation of the steering unit relative to the drive unit.

The cross slope control means further calculates an angle between the direction of travel of the blade and horizontal by solving the following equation:

$$R = \cos^{-1}\left[\frac{(\cos M - \tan\beta \cdot \sin\zeta \cdot \sin M)\cos\beta}{\cos\beta'}\right]$$

where R is the angle between the direction of travel of the blade and horizontal; $\beta'$ is an angle between the steering unit and the direction of travel of the blade projected into horizontal; $\zeta$ is the lateral slope angle of the front steering unit relative to horizontal; M is the longitudinal slope angle of the front steering unit relative to horizontal; and B is the angle between the front steering unit and the direction of travel of the blade.

The cross slope control means also calculates the angle between the steering unit and the direction of travel of the blade projected into horizontal by solving the following equation:

$$\beta' = \tan^{-1}\left[\frac{\tan\beta \cdot \cos\zeta}{\cos M - \tan\beta \cdot \sin\zeta \cdot \sin M}\right]$$

where $\beta'$ is the angle between the steering unit and the direction of travel of the blade projected into horizontal; $\zeta$ is the lateral slope angle of the front steering unit relative to horizontal; M is the longitudinal slope angle of the front steering unit relative to horizontal; and $\beta$ is the angle between the front steering unit and the direction of travel of the blade.

The cross slope control means additionally calculates a blade rotation angle relative to the front steering unit and projected into horizontal by solving the following equation:

$$\theta' = \tan^{-1}\left[\frac{\sin[\cos^{-1}(\cos\theta \cdot \cos\zeta)] \cdot \cos\left[\tan^{-1}\left(\frac{\sin\zeta}{\tan\theta}\right) + M\right]}{\cos\theta \cdot \cos\zeta}\right]$$

where $\Theta'$ is the blade rotation angle relative to the front steering unit projected into horizontal; $\Theta$ is the blade rotation angle relative to the front steering unit measured by the first angle sensor means; $\zeta$ is the lateral slope angle of the front steering unit relative to horizontal; and M is the longitudinal slope angle of the front steering unit relative to horizontal.

Angle $\tau'$, which is employed by the cross slope control means while determining the required blade slope angle BS, is equal to the summation of the angle $\Theta'$ and the angle $B\beta'$.

In accordance with a second aspect of the present invention, apparatus is provided for controlling the cross slope angle of a surface being worked by a motorgrader having a two-part articulated frame defined by a rear drive unit including rear drive wheels and a front steering unit which can be rotated relative to the drive unit and including front steering wheels. A blade is supported upon the steering unit for rotation about a generally vertical axis with the blade being mounted for adjustment of the elevations of its ends to define a blade slope angle relative to horizontal. The apparatus comprises: input means for selecting a desired cross slope angle; first angle sensor means for sensing the angle of rotation of the blade relative to the steering unit; second angle sensor means for sensing the angle of rotation of the steering unit relative to the drive unit; and third angle sensor means for sensing the angle of rotation of the front steering wheels relative to the steering unit. First slope sensor means sense the blade slope angle of the blade relative to horizontal and second slope sensor means sense the longitudinal slope angle of the front steering unit relative to horizontal. Cross slope control means are connected to the input means, to the first, second and third angle sensor means, and to the first and second slope sensor means for controlling the blade slope angle to maintain the desired cross slope when the motorgrader is being steered through a turn.

The blade slope angle required to maintain the desired cross slope is calculated by the cross slope control means using the equation:

$$\tan BS = (\sin\tau'')(\tan R') + (\cos\tau'')(\tan CS)$$

where BS is the required blade slope angle of the blade relative to horizontal; $\tau''$ is a rotational angle of the blade with respect to the blade's direction of travel projected into horizontal with the lateral slope angle of the front steering unit set equal to zero; R' is an angle between horizontal and the direction of travel of the blade with the lateral slope angle of the front steering unit set equal to zero; and CS is the desired cross slope angle, and the cross slope control means controls the blade slope so that the sensed blade slope angle is substantially equal to the calculated blade slope angle to maintain the desired cross slope when the motorgrader is operated in a crabbed steering position.

In accordance with a third aspect of the present invention, a method is provided for controlling the cross slope angle of a surface being worked by a motorgrader having a two-part articulated frame defined by a rear drive unit including rear drive wheels and a front steering unit which can be rotated relative to the drive unit and including front steering wheels. A blade is supported upon the steering unit for rotation about a generally vertical axis with the blade being mounted for adjustment of the elevations of its ends to define a blade slope angle relative to horizontal. The method comprises the steps of: selecting a desired cross slope angle; sensing the angle of rotation of the blade relative to the steering unit; sensing the angle of rotation of the steering unit relative to the drive unit; sensing the angle of rotation of the front steering wheels relative to the steering unit; sensing the blade slope angle of the blade relative to horizontal; sensing the longitudinal slope angle of the front steering unit relative to horizontal; sensing the lateral slope angle of the front steering unit relative to horizontal; and controlling the blade slope angle to maintain the desired cross slope when the motorgrader is being steered through a turn.

The step of controlling the blade slope angle to maintain the desired cross slope comprises the steps of calculating a required blade slope angle using the equation:

$$\tan BS = (\sin \tau')(\tan R) + (\cos \tau')(\tan CS)$$

where BS is the required blade slope angle of the blade relative to horizontal; $\tau'$ is a rotational angle of the blade with respect to the blade's direction of travel projected into horizontal; R is an angle between the blade's direction of travel and horizontal; and CS is the desired cross slope angle, and controlling the blade slope so that the sensed blade slope angle is substantially equal to the calculated blade slope angle to maintain the desired cross slope when the motorgrader is operated in a crabbed steering position.

The step of sensing the angle of rotation of the steering unit relative to the drive unit comprises the step of installing an angle sensor at an articulation joint interconnecting the steering unit to the drive unit. The step of sensing the angle of rotation of the front steering wheels relative to the front steering unit comprises the step of installing an angle sensor adjacent and coupled to the front steering wheels.

In accordance with a fourth aspect of the present invention, a method is provided for controlling the cross slope angle of a surface being worked by a motorgrader having a two-part articulated frame defined by a rear drive unit including rear drive wheels and a front steering unit which can be rotated relative to the drive unit and including front steering wheels. A blade is supported upon the steering unit for rotation about a generally vertical axis with the blade being mounted for adjustment of the elevations of its ends to define a blade slope angle relative to horizontal. The method comprises the steps of: selecting a desired cross slope angle; sensing the angle of rotation of the blade relative to the steering unit; sensing the angle of rotation of the steering unit relative to the drive unit; sensing the angle of rotation of the front steering wheels relative to the steering unit; sensing the blade slope angle of the blade relative to horizontal; sensing the longitudinal slope angle of the front steering unit relative to horizontal; and controlling the blade slope angle to maintain the desired cross slope when the motorgrader is being steered through a turn.

The step of controlling the blade slope angle to maintain the desired cross slope comprises the steps of calculating a required blade slope angle using the equation:

$$\tan BS = (\sin \tau')(\tan R') + (\cos \tau'')(\tan CS)$$

where BS is the required blade slope angle of the blade relative to horizontal; $\tau''$ is a rotational angle of the blade with respect to the blade's direction of travel projected into horizontal with the lateral slope angle of the front steering unit set equal to zero; R' is an angle between horizontal and the direction of travel of the blade with the lateral slope angle of the front steering unit set equal to zero; and CS is the desired cross slope angle, and controlling the blade slope so that the sensed blade slope angle is substantially equal to the calculated blade slope angle to maintain the desired cross slope when the motorgrader is operated in a crabbed steering position.

It is thus an object of the present invention to provide an improved method and apparatus for controlling the cross slope cut by the blade of an articulated frame motorgrader which is effective while the motorgrader is being steered through a turn, is operated in a straight frame mode, a crabbed steering position or in a non-horizontal plane. This and other objects and advantages of the invention will be apparent from the following description, the accompanying drawings and the appended claims.

DETAILED DESCRIPTION OF THE INVENTION

Figure 2:
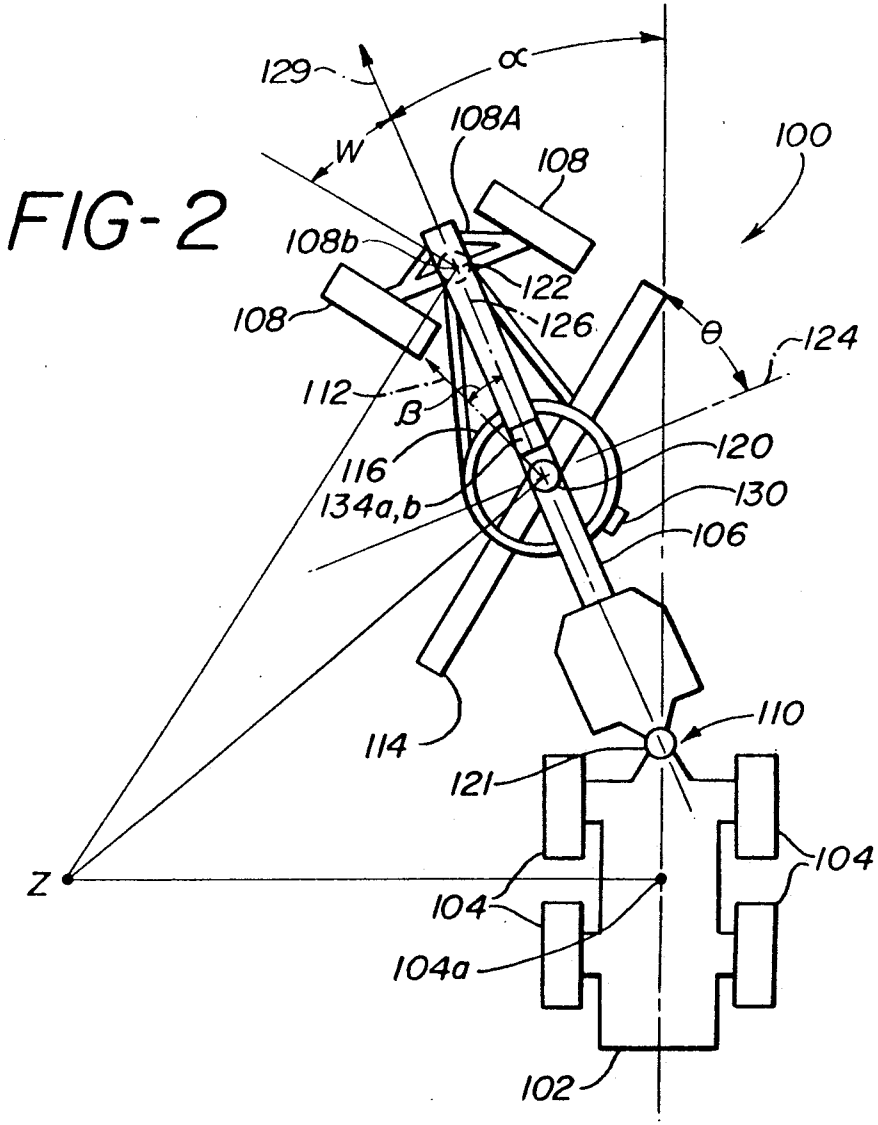
FIG. 2 is a schematic plan view of an articulated frame motorgrader being steered through a turn.
Figure 1:
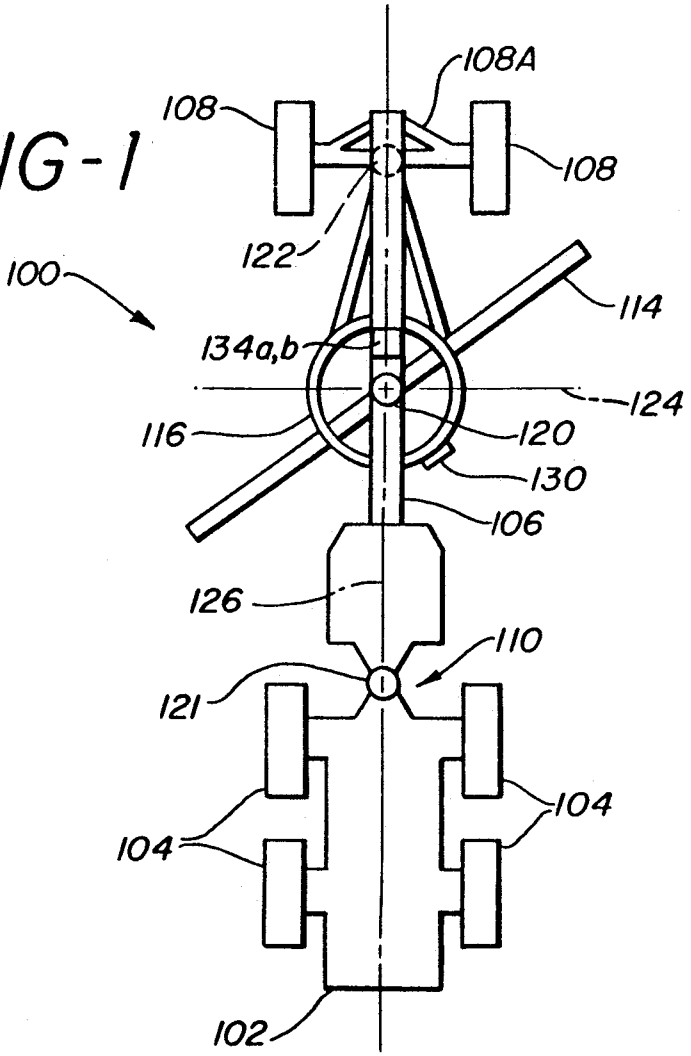
FIG. 1 is a schematic plan view of an articulated frame motorgrader illustrating straight frame operation.

Reference is now made to the drawing figures wherein FIGS. 1 and 2 schematically illustrate a two-part articulated frame motorgrader 100 in plan view. The motorgrader 100 includes a rear drive unit 102 including rear drive wheels 104 and a front steering unit or main frame 106 including front steering wheels 108. The front steering unit 106 is connected to the rear drive unit 102 by a frame articulation joint 110 so that the steering unit 106 can be rotated relative to the drive unit 102 to assist the steering wheels 108 in steering the motorgrader 100 through a turn, as shown in FIG. 2.

A blade 114 is supported upon the steering unit 106 by means of a draw bar/turntable arrangement commonly referred to as a "ring" or "circle" 116 so that the blade 114 can be rotated about a generally vertical axis collinear with the center of the circle 116. When the motorgrader 100 is operated in the straight frame orientation of FIG. 1, the control system of U.S. Pat. No. 3,786,871, which is incorporated herein by reference, or an equivalent system is normally capable of maintaining a desired cross slope, i.e., the amount of slope that exists on the ground along a perpendicular to the direction of travel of the motorgrader's blade, for the cut being made by the motorgrader 100. When the motorgrader 100 is operated in an articulated frame orientation or crabbed steering mode, the control system of U.S. Pat. No. 4,926,948, which is incorporated herein by reference, is normally capable of maintaining a desired cross slope for the cut being made by the motorgrader 100. If, however, the motorgrader 100 is traveling in a steep slope condition, e.g., traveling uphill, downhill or on a side slope, the cross slope of the cut being made by the motorgrader may deviate slightly from the desired cross slope. Further, when the motorgrader 100 is steered through a turn, as shown in FIG. 2, such control systems are usually ineffective to accurately control the cross slope of the cut being made by the motorgrader 100.

In accordance with the present invention, a method and apparatus are provided to control the cross slope of the cut being made by the motorgrader 100 even when the motorgrader 100 is being steered through a turn. The apparatus required for operation of the present invention includes input means comprising an input device 118, see FIG. 3, such as a keyboard or the like, for selecting a desired cross slope angle CS. The input device 118 is typically mounted in the operator's cab (not shown) for the motorgrader 100. First angle sensor means comprising a blade angle sensor 120 senses the angle of rotation Θ of the blade 114 relative to the steering unit 106. As shown in FIG. 2, the blade angle of rotation Θ is measured relative to a line 124 perpendicular to the centerline axis 126 of the steering unit 106 so that a zero degree blade rotation angle corresponds to positioning the blade 114 perpendicular to the steering unit 106. Further, for proper operation of the present invention, the circle 116 must remain centered relative to the steering unit 106 and not be side-shifted.

Second angle sensor means comprising an angle sensor 121 senses the angle of rotation $\alpha$ of the steering unit 106 relative to the drive unit 102. The angle sensor 121 is mounted at or near the articulation joint 110 interconnecting the steering unit 106 to the drive unit 102 so that the rotation angle $\alpha$ is directly sensed.

Third angle sensor means comprising an angle sensor 122 senses the angle of rotation W of the front steering wheels 108 relative to the steering unit 106. As shown in FIGS. 1 and 2, the sensor 122 is mounted generally between the front steering wheels 108 and coupled thereto for example by steering linkages 108A. Of course, the sensor 122 could be positioned directly adjacent to one of the front steering wheels 108 to more directly sense the rotation angle W, if desired. The angle sensors 120, 121 and 122 may comprise, among other devices, a potentiometer (Model CP 22-415), commercially available from Waters Manufacturing Division of Tally Industries, Inc.

Figure 3:
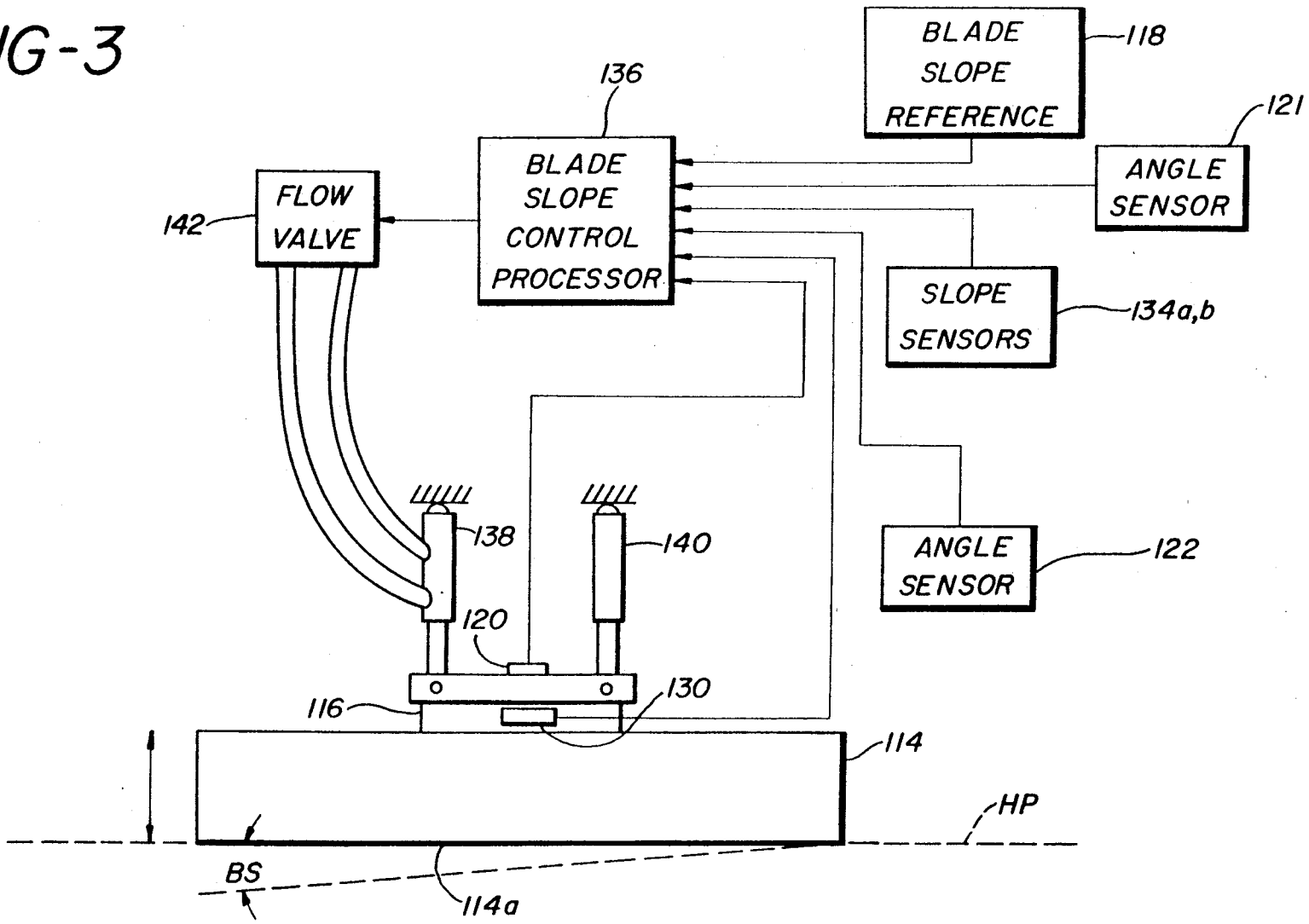
FIG. 3 is a schematic block diagram showing the application of the present invention for cross slope control in a motorgrader.

First slope sensor means comprising a first slope sensor 130 senses the blade slope angle BS of the blade 114 relative to horizontal HP, see FIG. 3. As shown, the slope sensor 130 is mounted on the circle 116; however, it can be mounted on the blade 114 or other blade supporting structure as preferred for a given application. Second slope sensor means comprising second and third slope sensors 134*a* and 134*b*, which are located in a common housing, are mounted on the front steering unit 106. Slope sensor 134*a* senses the longitudinal slope angle M of the front steering unit 106 in its direction of travel 129 relative to horizontal HP and slope sensor 134*b* senses the lateral slope angle $\zeta$ of the front steering unit 106 in a direction which is 90° to its direction of travel 129 and relative to horizontal HP. Finally, cross slope control means comprising a blade slope control processor 136 in the illustrated embodiment is connected and responsive to the input device 118, to the angle sensors 120 and 121 or 122, and to the first, second and third slope sensors 130, 134*a* and 134*b* to control the blade slope angle BS to maintain the desired cross slope angle CS even when the motorgrader 100 is being steered through a turn, as shown in FIG. 2, and/or is traveling in a steep slope condition. The first, second and third slope sensors 130, 134*a* and 134*b* can comprise, among other available devices, sensors sold by Lucas Sensing Systems, Inc. under the tradename Accustar II.

It is noted that for the present control system to function properly, the front wheels 108 of the motorgrader 100 must be positioned in a vertical plane, i.e., they must not lean to either side of vertical. When the front wheels 108 lean to one side or another of vertical, the front of the motorgrader 100 is lowered by an amount proportional to the lean angle. This causes error in the calculation of the required blade slope angle BS since the second slope sensor means 134*a*, 134*b* is no longer calibrated to horizontal.

In FIG. 3, a blade cross slope control system operable in accordance with the present invention for the grader blade 114 of the motorgrader 1? ? is shown in schematic block diagram form from a rear view of the grader blade 114. The elevation of the ring 116 and hence the elevation of the blade 114 is controlled by a pair of hydraulic cylinders 138 and 140 which are well known and hence only shown schematically in the block diagram of FIG. 3. The blade slope control processor 136 controls the cylinder 138 via a flow valve 142 with the cylinder 140 being controlled by an operator of the motorgrader 100 or an elevation positioning device (not shown), such as a laser control system or a string line control system, which is well known in the art and hence not described herein. It should be apparent that other earthworking tools in addition to a grader blade can be mounted in a variety of ways such that the blade or other tool is supported by a pair of hydraulic cylinders, such as the cylinders 138 and 140, which control both the elevation and slope of the blade or other tool. The present invention is equally applicable for controlling the cross slope of such tools as should be apparent from the present disclosure.

Equations will now be developed for the operation of the blade slope control processor 136 of FIG. 3 with reference to FIG. 2, and FIGS. 4–6. The following angular orientations are monitored or controlled by the slope control processor 136: BS— the required blade slope angle of the blade 114 relative to horizontal; W—the angle of rotation of the front steering wheels 108 relative to the steering unit 106; $\alpha$—the angle of rotation of the steering unit 106 relative to the drive unit 102; Θ—the angle of rotation of the blade 114 relative to the steering unit 106; M—the longitudinal slope angle of the motorgrader 100 in relationship to horizontal; $\zeta$—the lateral slope angle of the motorgrader 100 in relationship to horizontal; and, CS—the desired cross slope angle as selected by the operator using the blade slope reference 118.

A first equation (a) will now be derived which allows the blade slope control processor 136 to determine the required blade slope angle BS of the blade 114 for a desired cross slope angle CS. This equation provides the proper blade slope angle BS for the blade 114 when the motorgrader 100 is operated in a straight frame mode, is being steered through a turn, or is operated in a crabbed steering position. Additionally, this equation provides the proper blade slope angle BS even if the motorgrader 100 is operated in a steep slope condition. By making reference to FIG. 4, which illustrates the blade's lower edge 114*a* and the blade's true direction of travel 112, the following derivation of equation (a) should be apparent:

$$\tan(BS) = \frac{g}{e}$$

$$e = \sqrt{f^2 + a^2}$$

$$f = a \tan \tau'$$

$$\tan R = \frac{g - c}{f}$$

$$g = f \tan(R) + c$$

$$c = a \tan(CS)$$

$$\tan(BS) = \frac{g}{e}$$

$$\tan(BS) = \frac{f \cdot \tan(R) + c}{\sqrt{f^2 + a^2}}$$

$$\tan(BS) = \frac{a \cdot \tan(\tau') \cdot \tan(R) + a \cdot \tan(cs)}{\sqrt{(a \cdot \tan(\tau'))^2 + a^2}}$$

$$\tan(BS) = \frac{a(\tan(\tau') \cdot \tan(R) + \tan(cs))}{a\sqrt{(\tan(\tau'))^2 + 1}}$$

$$\tan(BS) = \frac{\tan(\tau') \cdot \tan(R) + \tan(cs)}{\sqrt{(\tan^2(\tau') + 1}}$$

$$\cos(\tau') = \frac{1}{\sqrt{\tan^2(\tau') + 1}}$$

$$\tan(BS) = \cos(\tau') \cdot \tan(\tau') \cdot \tan(R) + \cos(\tau') \tan(cs)$$

$$\tan(BS) = \sin(\tau') \cdot \tan(R) + \cos(\tau') \cdot \tan(cs) \qquad \text{(a)}$$

wherein BS is the required blade slope angle of the blade 114 relative to a horizontal plane HP; $\tau'$ is the rotational angle of the blade with respect tot he blade's direction of travel 112 projected into the horizontal plane P; R is the angle between the blades direction of travel 112 and the horizontal plane HP; and CS is the desired cross slope angle as selected by the operator using the blade slope reference 118.

Figure 4:
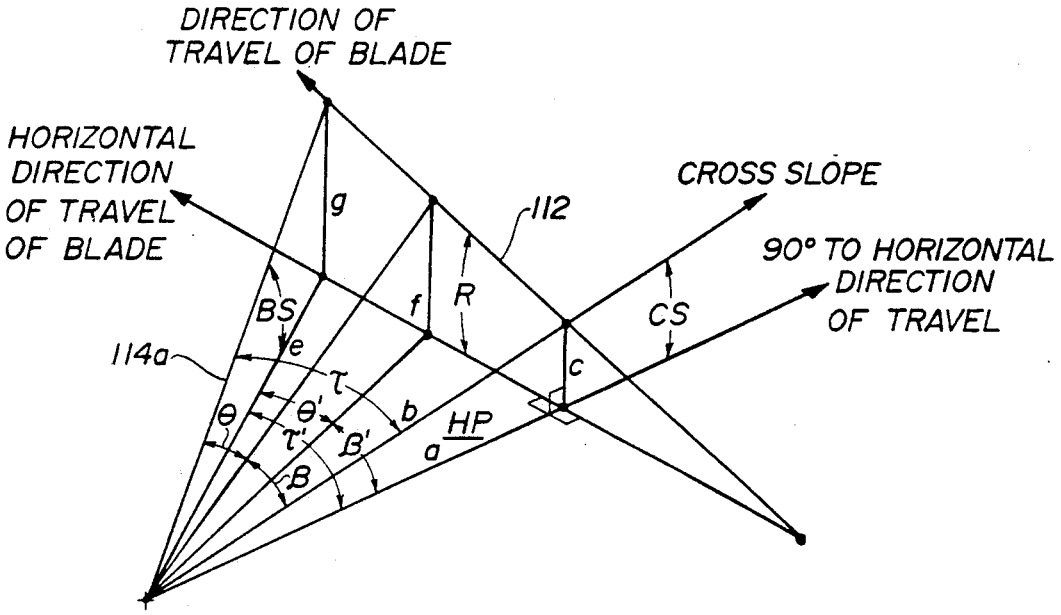
FIGS. 4–8 are line drawings illustrating relative orientations of components of a motorgrader which are employed to derive equations employed by the method and apparatus of the present invention for determining the required blade slope angle for a desired cross slope angle.

As shown in FIG. 4, angle $\tau'$ is equal to angle $\Theta'$+ angle $\beta'$, wherein angle $\Theta'$ comprises the blade rotation angle $\Theta$ projected into the horizontal plane HP; and $\beta'$ comprises the angle between the mainframe 106 and the blade's true direction of travel 112 projected into the horizontal plane HP. A second equation (b) will now be derived which will be employed by the control processor 136 to determine the blade rotation angle $\Theta'$. Angle $\Theta'$ is employed by the processor 136 to determine $\Theta'$, which, in turn, is employed by the processor 136 in equation (a) to determine the required blade slope angle BS.

Figure 5:
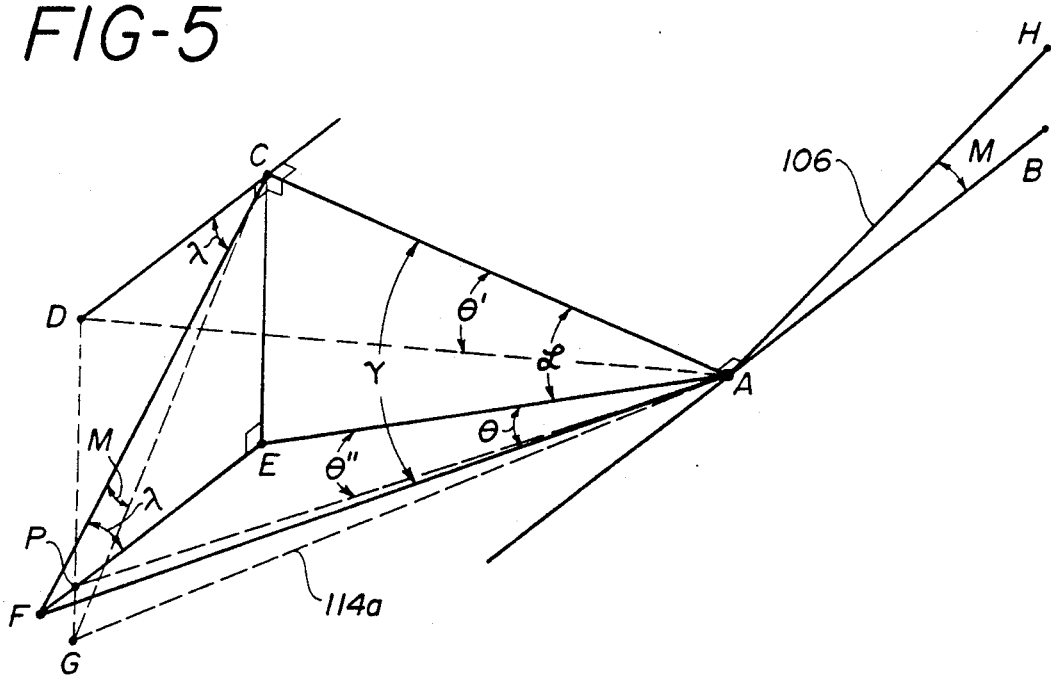

FIG. 5 is employed to derived equation (b) and illustrates: a center point A on the cutting edge 114*a* of the blade 114 which intersects a vertical plane located along the centerline axis 126 of the front steering unit 106; a horizontal vector AB which is positioned parallel to the centerline axis 126 of the front steering unit 106 and extends from point A to a point B which is collinear with a centerpoint 108*b* positioned between front wheels 108, as shown in FIG. 2; a vector AH which represents a portion of the front steering unit 106; a vector AG which represents the bottom edge 114*a* of the blade 114; a vector AF which represents the blade's position when the longitudinal slope angle M is zero; a horizontal vector AC which is normal to the centerline axis 126 of the front steering unit 106; and a vector AD representing the blade's position projected into the horizontal plane. By making reference to FIG. 5, the following derivation of equation (b) should be apparent:

$$AE = AF \cdot \cos\theta$$

$$AC = AE \cdot \cos\zeta$$

$$AC = AF \cdot \cos\theta \cdot \cos\zeta$$

$$EF = AE \cdot \tan\theta$$

$$CE = AC \cdot \tan\zeta$$

$$\tan\lambda = \frac{CE}{EF}$$

$$\tan\lambda = \frac{AC \cdot \tan\zeta}{AE \cdot \tan\theta}$$

$$\tan\lambda = \frac{AE \cdot \cos\zeta \cdot \tan\zeta}{AE \cdot \tan\theta}$$

$$\tan\lambda = \frac{\sin\zeta}{\tan\theta}$$

$$\lambda = \tan^{-1}\left(\frac{\sin\zeta}{\tan\theta}\right)$$

$$\cos\gamma = \frac{AC}{AF}$$

$$\cos\gamma = \frac{AF \cdot \cos\theta \cdot \cos\zeta}{AF}$$

$$\gamma = \cos^{-1}(\cos\theta \cdot \cos\zeta)$$

$$\frac{CF}{AF} = \sin\gamma$$

$$\frac{CF}{AF} = \sin[\cos^{-1}(\cos\theta \cdot \cos\zeta)]$$

$$CD = CG \cos(\lambda + M)$$

$$CD = CF \cos\left[\tan^{-1}\frac{(\sin\zeta)}{(\tan\theta)} + M\right]$$

$$\tan\theta' = \frac{CD}{AC}$$

$$\tan\theta' = \frac{CF \cdot \cos\left[\tan^{-1}\left(\frac{\sin\zeta}{\tan\theta}\right) + M\right]}{AF \cdot \cos\theta \cdot \cos\zeta}$$

$$\tan\theta' = \frac{\sin[\cos^{-1}(\cos\theta \cdot \cos\zeta)] \cdot \cos\left[\tan^{-1}\left(\frac{\sin\zeta}{\tan\theta}\right) + M\right]}{\cos\theta \cdot \cos\zeta}$$

$$\theta' = \tan^{-1}\left[\frac{\sin[\cos^{-1}(\cos\theta \cdot \cos\zeta)] \cdot \cos\left[\tan^{-1}\left(\frac{\sin\zeta}{\tan\theta}\right) + M\right]}{\cos\theta \cdot \cos\zeta}\right] \qquad \text{(b)}$$

wherein angle $\Theta'$ comprises the blade rotation angle 8 projected into the horizontal plane HP; $\Theta$ is equal to the blade rotation angle measured by blade angle sensor 120; $\Theta$ is equal to the lateral slope angle measured by the slope sensor 134*b*; and M is equal to the longitudinal slope along the front steering unit 106 measured by the slope sensor 134*a*.

Figure 6:
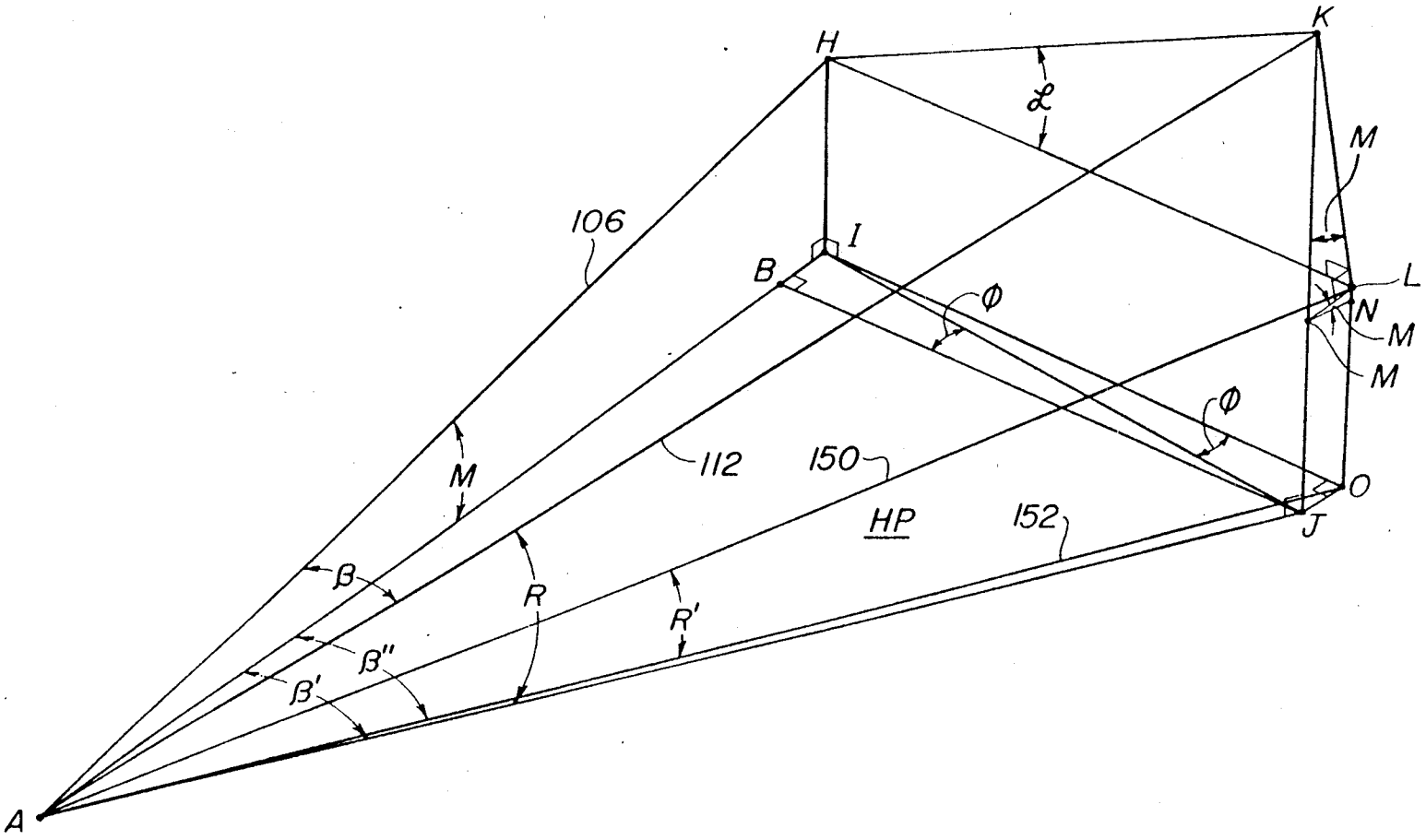

Third and fourth equations (c) and (d), respectively, will now be derived which will be employed by the control processor 136 to determine angles B' and R. As set forth above, angle $\beta'$ is employed by the processor 136 to determine $\tau'$, and R is employed by the processor 136 in equation (a) to determine the required blade slope angle BS. FIG. 6 is employed to derived equations (c) and (d) and illustrates: center point A on the blade's cutting edge 114*a*; a vector AK along the blade's true direction of travel 112; the horizontal vector AB which is positioned parallel to the centerline axis 126 of the front steering unit 106 and extends from point A to point B, which is collinear with a centerpoint 108*b* between front wheels 108; a vector AH which represents a portion of the front steering unit 106; a vector AJ along the blade's direction of travel 112 projected into the horizontal plane HP; and a vector AH which represents the front steering unit's 106 angular position with respect to the horizontal plane HP. By making reference to FIG. 6, the following derivation of equations (c) and (d) should be apparent:

$$\tan\phi = \frac{JO}{IO}$$

$$MN = JO$$

$$\cos M = \frac{MN}{ML}\ ;\ MN = ML \cdot \cos M = JO$$

$$\tan M = \frac{ML}{KL}\ ;\ ML = KL \cdot \tan M$$

$$JO = KL \cdot \tan M \cdot \cos M = KL \cdot \sin M$$

$$\tan\zeta = \frac{KL}{HL}\ ;\ KL = HL \cdot \tan\zeta$$

$$JO = HL \cdot \tan\zeta \cdot \sin M$$

$$HL = IO = BJ$$

$$\tan\phi = \frac{JO}{IO} = \frac{HL \cdot \tan\zeta \cdot \sin M}{HL}$$

$$\tan\phi = \tan\zeta \cdot \sin M$$

$$BI = BJ \cdot \tan\phi$$

$$HL = HK \cdot \cos\zeta = BJ$$

$$BI = HK \cdot \cos\zeta \cdot \tan\phi$$

$$HK = AH \cdot \tan\beta$$

$$BI = AH \cdot \tan\beta \cdot \cos\zeta \cdot \tan\zeta \cdot \sin M$$

$$BI = AH \cdot \tan\beta \cdot \sin\zeta \cdot \sin M$$

$$AB = AI - BI$$

$$AI = AH \cdot \cos M$$

$$AB = AH \cdot \cos M - AH \cdot \tan\beta \cdot \sin\zeta \cdot \sin M$$

$$\tan\beta' = \frac{BJ}{AB}$$

$$BJ = AH \cdot \tan\beta \cdot \cos\zeta$$

$$\tan\beta' = \frac{AH \cdot \tan\beta \cdot \cos\zeta}{AH(\cos M - \tan\beta \cdot \sin\zeta \cdot \sin M)}$$

$$\beta' = \tan^{-1}\left[\frac{\tan\beta \cdot \cos\zeta}{\cos M - \tan\beta \cdot \sin\zeta \cdot \sin M}\right] \quad \text{(c)}$$

-continued $$\cos\beta' = \frac{AB}{AJ}\ ;\ AJ = \frac{AB}{\cos\beta'}$$

$$\cos\beta = \frac{AH}{AK}\ ;\ AK = \frac{AH}{\cos\beta}$$

$$\cos R = \frac{AJ}{AK}\ ;\ \frac{\frac{AB}{\cos\beta'}}{\frac{AH}{\cos\beta}} = \frac{AB \cdot \cos\beta}{AH \cdot \cos\beta'}$$

$$\cos R = \frac{AH[\cos M - \tan\beta \cdot \sin\zeta \cdot \sin M] \cdot \cos\beta}{AH \cdot \cos\beta'}$$

$$R = \cos^{-1}\left[\frac{(\cos M - \tan\beta \cdot \sin\zeta \cdot \sin M)\cos\beta}{\cos\beta'}\right] \quad \text{(d)}$$

wherein $\beta'$ is equal to the angle between the mainframe 106 and the blade's true direction of travel 112 projected into the horizontal plane HP; $\zeta$ is equal to the lateral slope angle measured by the slope sensor 134*b*; M is equal to the longitudinal slope along the front steering unit 106 measured by the slope sensor 134*a*; angle $\beta$ is equal to the angle between the mainframe 106 and the blade's true direction of travel 112; and R is equal to the angle between the blade's direction of travel 112 and the horizontal plane HP.

Figure 7:
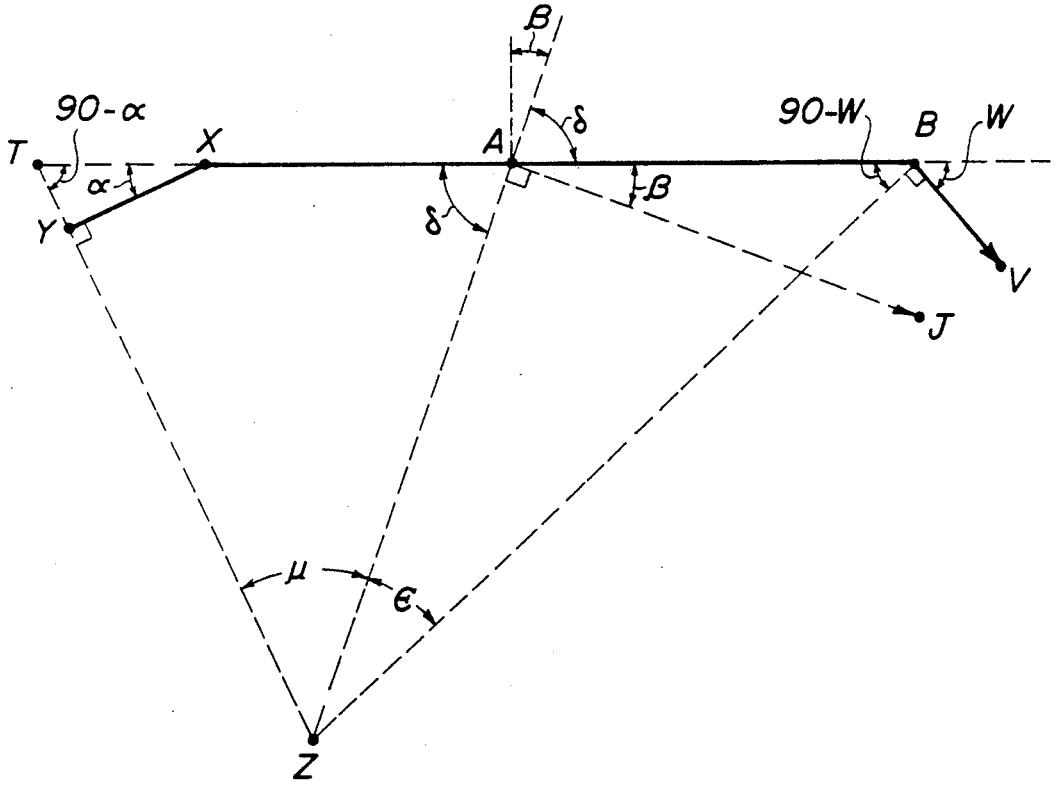

A fifth equation (e) will now be derived which will be employed by the processor 136 to determine angle $\beta$ which is equal to the angle between the front steering unit 106 and the blade's true direction of travel 112. Angle $\beta$ is employed by the processor 136 in equations (c) and (d), discussed above. FIG. 7 is employed to derive equation (e) and illustrates: center point A on the blade's cutting edge 114*a*the vector AJ along the blade's true direction of travel 112 projected in the horizontal plane HP; the horizontal vector AB which is positioned parallel to the centerline axis 126 of the front steering unit 106 and extends from point A to point B, which is collinear with the centerpoint 108*b* positioned between the front wheels 108; an articulation pivot point X which is located on a vertical axis which extends through the center of the articulation joint 110; a point Y which is located on a vertical axis which extends through a center point 104*a* positioned between the rear wheels 104, shown in FIG. 2; and a point Z which is the instantaneous center of rotation of the motorgrader 100, also shown in FIG. 2. By making reference to FIG. 7, the following derivation of equation (e) should be apparent:

$$\frac{\sin(90 - \alpha)}{AZ} = \frac{\sin\mu}{(AX + TX)}$$

$$TX = \frac{XY}{\cos\alpha}$$

$$\frac{\sin(90 - W)}{AZ} = \frac{\sin\epsilon}{AB}$$

$$90 - \alpha + \delta + \mu = 180$$

$$\mu = 90 + \alpha - \delta$$

$$\delta = 90 - \beta$$

$$\mu = \alpha + \beta$$

$$\epsilon + 90 + \beta + 90 - W = 180$$

$$\epsilon = W - \beta$$

and 8. Angle Θ″ is determined from the following equation:

$$\theta'' = \tan^{-1}\left[\frac{\sin\theta \cdot \cos M}{\cos\theta}\right]$$

wherein Θ is the angle of rotation of the blade 114 relative to the steering unit 106, sensed by blade angle sensor 120; and M is the longitudinal slope angle of the front steering unit relative to horizontal.

Figure 8:
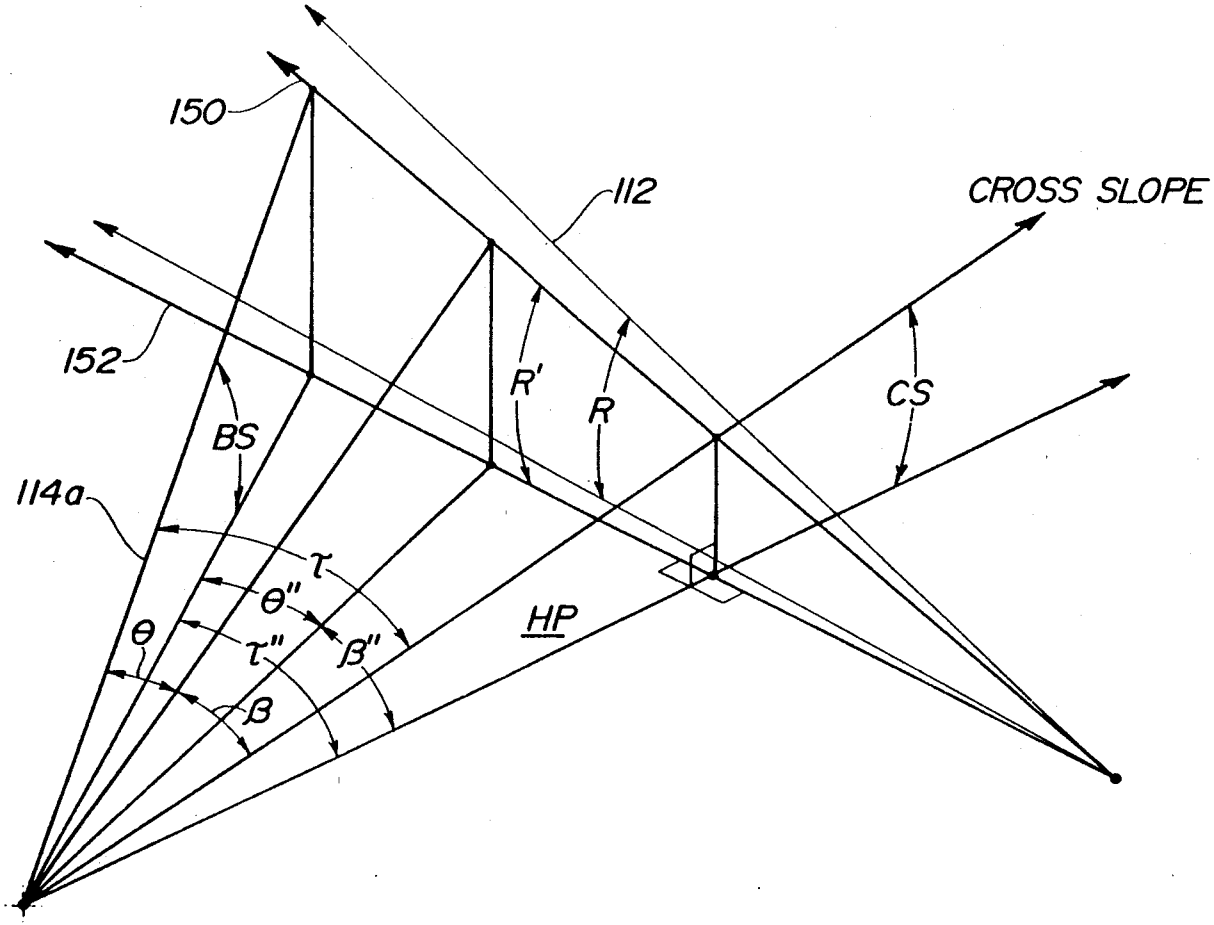

Angle R′ is determined from the following equation:

$$R' = \cos^{-1}\left[\frac{\cos M \cdot \cos\beta}{\cos\beta''}\right]$$

wherein $\beta$ is the angle between the mainframe 106 and the blade's true direction of travel 112; $\beta''$ is the angle between the mainframe 106 and the blade's true direction of travel 112 projected into horizontal with the lateral slope angle $\zeta$ set equal to zero; and M is the longitudinal slope angle of the front steering unit 106 relative to horizontal. Angle R′ is shown in FIGS. 6 and 8 between lines 150 and 152. Line 150 represents the direction of travel of the blade when $\zeta$ is set equal to zero, and line 152 represents the horizontal direction of travel of the blade when $\zeta$ is set equal to zero.

Having thus described the method and apparatus for controlling motorgrader cross slope cut of the present invention in detail and by reference to preferred embodiments thereof, it will be apparent that modifications and variations are possible without departing from the scope of the invention defined in the appended claims.

What is claimed is:

1. In a motorgrader having a two-part articulated frame defined by a rear drive unit including rear drive wheels and a front steering unit which can be rotated relative to the drive unit and including front steering wheels, and a blade supported upon the steering unit, the blade being rotatable about a generally vertical axis and being mounted for adjustment of the elevations of the ends of the blade to define a blade slope angle relative to horizontal, apparatus for controlling the cross slope angle of a surface being worked by the motorgrader comprising:

input means for selecting a desired cross slope angle;

first angle sensor means for sensing the angle of rotation of the blade relative to the steering unit;

second angle sensor means for sensing the angle of rotation of said steering unit relative to the drive unit;

third angle sensor means for sensing the angle of rotation of the front steering wheels relative to the steering unit;

first slope sensor means for sensing the blade slope angle of said blade relative to horizontal;

second slope sensor means for sensing the longitudinal and lateral slope angles of the front steering unit relative to horizontal; and cross slope control means connected to said input means, to said first, second and third angle sensor means, and to said first and second slope sensor means for controlling said blade slope angle to maintain said desired cross slope when said motorgrader is being steered through a turn.

2. Apparatus for controlling the cross slope angle of a surface being worked by a motorgrader as claimed in claim 1 wherein said motorgrader further includes a circle unit connected to said steering unit and mounting said blade thereon, and said first angle sensor means being located at a center pivot point of said circle unit.

3. Apparatus for controlling the cross slope angle of a surface being worked by a motorgrader as claimed in claim 1 wherein said second angle sensor means is mounted at an articulation joint interconnecting said steering unit to said drive unit.

4. Apparatus for controlling the cross slope angle of a surface being worked by a motorgrader as claimed in claim 1 wherein said third angle sensor means is mounted adjacent and coupled to said front steering wheels.

5. Apparatus for controlling the cross slope angle of a surface being worked by a motorgrader as claimed in claim 1 wherein said second slope sensor means comprises first and second slope sensors.

6. Apparatus for controlling the cross slope angle of a surface being worked by a motorgrader as claimed in claim 1 wherein the blade slope angle required to maintain the desired cross slope is calculated by said cross slope control means using the equation:

$$\tan BS = (\sin\tau')(\tan R) + (\cos\tau')(\tan CS)$$

where BS is the required blade slope angle of said blade relative to horizontal; $\tau'$ is a rotational angle of the blade with respect to the blade's direction of travel projected into horizontal; R is an angle between the blade's direction of travel and horizontal; and CS is the desired cross slope angle, and said cross slope control means controls said blade slope so that the sensed blade slope angle is substantially equal to the calculated blade slope angle to maintain said desired cross slope when said motorgrader is steered through a turn.

7. Apparatus for controlling the cross slope angle of a surface being worked by a motorgrader as claimed in claim 1 wherein said motorgrader further includes an articulation joint interconnecting said front steering unit to said rear drive unit.

8. Apparatus for controlling the cross slope angle of a surface being worked by a motorgrader as claimed in claim 7, wherein an angle between said front steering unit and the direction of travel of said blade is calculated by said cross slope control means by solving the following equation:

$$\beta = \tan^{-1}\left[\frac{\tan W(XY + AX \cdot \cos\alpha - AB \cdot \sin\alpha \cdot \cot W)}{AB \cdot \cos\alpha + AX\cos\alpha + XY}\right]$$

wherein $\beta$ is said angle between said front steering unit and the direction of travel of said blade; W is the angle of rotation of wheels relative to said steering unit; XY is said front steering equal to the distance between said articulation joint and a center point between said rear wheels; AX is equal to the distance between said articulation joint and a center point on said blade; AB is equal to the distance from a center point between said front wheels and said center point on said blade; and $\alpha$ is equal to the angle of rotation of said steering unit relative to said drive unit.

9. Apparatus for controlling the cross slope angle of a surface being worked by a motorgrader as claimed in -continued $$\frac{\sin(90 - W)}{AZ} = \frac{\sin(W - \beta)}{AB}$$

$$AZ = \frac{AB \cdot \sin(90 - W)}{\sin(W - \beta)}$$

$$\frac{\sin(90 - \alpha)}{AZ} = \frac{\sin(\alpha + \beta)}{AX + \frac{XY}{\cos\alpha}}$$

$$\frac{\sin(90 - \alpha) - \sin(W - \beta)}{AB \cdot \sin(90 - W)} = \frac{\sin(\alpha + \beta)}{AX + \frac{XY}{\cos\alpha}}$$

$$\frac{\cos\alpha \cdot (\sin W \cdot \cos\beta - \cos W \cdot \sin\beta)}{AB \cdot \cos W} = \frac{\sin\alpha \cdot \cos\beta + \cos\alpha \cdot \sin\beta}{AX + \frac{XY}{\cos\alpha}}$$

$$\frac{\cos\alpha \cdot (\sin W \cdot \cos\beta - \cos W \cdot \sin\beta)}{\sin\alpha \cdot \cos\beta + \cos\alpha \cdot \sin\beta} = \frac{AB \cdot \cos W}{AX + \frac{XY}{\cos\alpha}}$$

$$\frac{\cos\alpha \cdot \sin W \cdot \cos\beta - \cos\alpha \cdot \cos W \cdot \sin\beta}{\sin\alpha \cdot \cos\beta + \cos\alpha \cdot \sin\beta} = \frac{AB \cdot \cos W}{AX + \frac{XY}{\cos\alpha}}$$

$$\frac{\sin W \cdot \cos\beta - \cos W \cdot \sin\beta}{\tan\alpha \cdot \cos\beta + \sin\beta} = \frac{AB \cdot \cos W}{AX + \frac{XY}{\cos\alpha}}$$

$$\frac{\sin W - \cos W \cdot \tan\beta}{\tan\alpha + \tan\beta} + \frac{AB \cdot \cos W}{AX + \frac{XY}{\cos\alpha}}$$

$$\left(AX + \frac{XY}{\cos\alpha}\right)(\sin W - \cos W \cdot \tan\beta) = AB \cdot \cos W(\tan\alpha + \tan\beta)$$

$$AX \cdot \sin W - AX \cdot \cos W \cdot \tan\beta + \frac{XY \sin W}{\cos\alpha} - \frac{XY \cos W \cdot \tan\beta}{\cos\alpha} = AB \cdot \cos W \cdot \tan\alpha + AB \cdot \cos W \cdot \tan\beta$$

$$AX \cdot \sin W + \frac{XY \sin W}{\cos\alpha} - AB \cos W \cdot \tan\alpha = AB \cos W \cdot \tan\beta + AX \cos W \cdot \tan\beta + \frac{XY \cos W \cdot \tan\beta}{\cos\alpha}$$

$$AX \cdot \cos\alpha \cdot \sin W + XY \sin W - AB \cdot \cos\alpha \cdot \cos W \cdot \tan\alpha = AB \cos\alpha \cdot \cos W \cdot \tan\beta + AX \cos\alpha \cdot \cos W \cdot \tan\beta + XY \cdot \cos W \cdot \tan\beta$$

$$\sin W(XY + AX \cdot \cos\alpha - AB \cdot \cos\alpha \cdot \cot W \cdot \tan\alpha = \cos W \cdot \tan\beta\,(AB \cdot \cos\alpha + AX \cos\alpha + XY)$$

$$\frac{\tan W(XY + AX \cdot \cos\alpha - AB \cos\alpha \cdot \cot W \cdot \tan\alpha)}{AB \cdot \cos\alpha + AX \cos\alpha + XY} = \tan\beta$$

$$\beta = \tan^{-1}\left[\frac{\tan W(XY + AX \cdot \cos\alpha - AB \cdot \sin\alpha \cdot \cot W)}{AB \cdot \cos\alpha + AX \cos\alpha + XY}\right] \quad \text{(e)}$$

wherein $\beta$ is equal the angle between the front steering unit 106 and the blades true direction 112 of travel; W is equal to the angle of rotation of the front steering wheels 108 relative to the steering unit 106; XY is equal to the distance between the articulation joint 110 and the center point 104*a* between the rear wheels 104; AX is equal to the distance between the articulation joint 110 and point A on the blade 114; AB is equal to the distance from the center 108B between the front wheels 108 and point A on the blade 114; and $\alpha$ is equal to the angle of rotation of the steering unit 106 relative to the drive unit 102.

Equations (a)-(e) are utilized by the blade slope control processor 136 to determine the blade slope angel BS required to maintain the desired cross slope for a cut being made by the motorgrader 100. The cross slope control means or blade slope control processor 136 then controls the blade slope via the flow valve 142 and the cylinder 138 so that the sensed blade slope angle BS is maintained substantially equal to the calculated blade slope angle BS to maintain the desired cross slope angle CS even when the motorgrader 100 is being steered through a turn, as shown in FIG. 2. It is noted that the blade slope control processor 136 also functions to properly maintain the cross slope angle CS when the motorgrader 100 is operated in a straight frame mode, in a crabbed steering position, and/or in a steep slope condition.

In a second embodiment of the present invention, the required blade slope angle BS is determined without determining the lateral slope angle $\zeta$. The apparatus set forth above would be employed in such a control system, however, the slope sensor 134*b* would no longer be required. In such a system, the blade slope control processor 136 determines the require blade slope angle BS by solving the following equation:

$$\tan BS = (\sin \tau')(\tan R') + (\cos \tau')(\tan CS)$$

where BS is the required blade slope angle of the blade relative to horizontal; $\tau''$ is the rotational angle of the blade with respect to the blade's direction of travel projected into horizontal with the lateral slope angle $\zeta$ of the front steering unit 106 set equal to zero (see FIG. 8); R' is the angle between horizontal and the blade's direction of travel with the lateral slope angle $\zeta$ set equal to zero, (see FIGS. 6 and 8); and CS is the desired cross slope angle. Such a system, while not as accurate as the system which employs equation (a), above, would provide a close approximation for the required blade slope angle BS needed to achieve a desired cross slope CS and may be sufficiently accurate for certain applications of the present invention.

The rotational angle $\tau''$ of the blade 114 with respect to the blade's direction of travel projected into horizontal with the lateral slope angle $\zeta$ set equal to zero is determined by taking the summation of angles $\beta''$ and $\Theta''$. Angle $\beta''$ is the angle between the front steering unit 106 and the blade's direction of travel projected into horizontal with the lateral slope angle $\zeta$ set equal to zero, see FIGS. 6 and 8. Angle $\beta''$ is determined from the following equation:

$$B'' = \tan^{-1}\left[\frac{\tan B}{\cos M}\right]$$

wherein $\beta$ is the angle between the front steering unit 106 and the blade's direction of travel 112, see equation (e) supra; and M is the longitudinal slope angle of the front steering unit 106 relative to horizontal, measured by slope sensor 134*a*.

Angle $\Theta''$ is the blade rotation angle relative to the front steering unit 106 projected into horizontal with the lateral slope angle $\zeta$ set equal to zero, see FIGS. 5 claim 8, wherein an angle between the direction of travel of said blade and horizontal is calculated by said cross slope control means by solving the following equation:

$$R = \cos^{-1}\left[\frac{(\cos M - \tan\beta \cdot \sin\zeta \cdot \sin M)\cos\beta}{\cos\beta'}\right]$$

wherein R is said angle between the direction of travel of said blade and horizontal; $\beta'$ is an angle between said steering unit and the direction of travel of said blade projected into horizontal; $\zeta$ is the lateral slope angle of said front steering unit relative to horizontal; M is the longitudinal slope angle of said front steering unit relative to horizontal; and $\beta$ is the angle between the said front steering unit and the direction of travel of said blade.

10. Apparatus for controlling the cross slope angle of a surface being worked by a motorgrader as claimed in claim 9, wherein the angle between said steering unit and the direction of travel of said blade projected into horizontal is calculated by said cross slope control means by solving the following equation:

$$\beta' = \tan^{-1}\left[\frac{\tan\beta \cdot \cos\zeta}{\cos M - \tan\beta \cdot \sin\zeta \cdot \sin M}\right]$$

$\beta'$ is the angle between said steering unit and the direction of travel of said blade projected into horizontal; $\zeta$ is the lateral slope angle of said front steering unit relative to horizontal; M is the longitudinal slope angle of said front steering unit relative to horizontal; and B is the angle between the said front steering unit and the direction of travel of said blade.

11. Apparatus for controlling the cross slope angle of a surface being worked by a motorgrader as claimed in claim 10, wherein a blade rotation angle relative to the front steering unit and projected into horizontal is calculated by said cross slope control means by solving the following equation:

$$\theta' = \tan^{-1}\left[\frac{\sin[\cos^{-1}(\cos\theta \cdot \cos\zeta)] \cdot \cos\left[\tan^{-1}\left(\frac{\sin\zeta}{\tan\theta}\right) + M\right]}{\cos\theta \cdot \cos\zeta}\right]$$

wherein $\Theta'$ is the blade rotation angle relative to the front steering unit projected into horizontal; $\Theta$ is the blade rotation angle relative to said front steering unit measured by said first angle sensor means; $\zeta$ is the lateral slope angle of said front steering unit relative to horizontal; and M is the longitudinal slope angle of said front steering unit relative to horizontal.

12. Apparatus for controlling the cross slope angle of a surface being worked by a motorgrader as claimed in claim 11 wherein the blade slope angle required to maintain the desired cross slope is calculated by said cross slope control means using the equation:

$$\tan BS = (\sin\tau')(\tan R) + (\cos\tau')(\tan CS)$$

where BS is the required blade slope angle of said blade relative to horizontal; $\tau'$ is the rotational angle of the blade with respect to the blade's direction of travel projected into horizontal and is equal to the summation of the angle $\Theta'$ and the angle $\beta'$; R is the angle between the blade's direction of travel and horizontal; and CS is the desired cross slope angle, and said cross slope control means controls said blade slope so that the sensed blade slope angle is substantially equal to the calculated blade slope angle to maintain said desired cross slope when said motorgrader is operated in a crabbed steering position.

13. In a motorgrader having a two-part articulated frame defined by a rear drive unit including rear drive wheels and a front steering unit which can be rotated relative to the drive unit and including front steering wheels, and a blade supported upon the steering unit, the blade being rotatable about a generally vertical axis and being mounted for adjustment of the elevations of the ends of the blade to define a blade slope angle relative to horizontal, apparatus for controlling the cross slope angle of a surface being worked by the motorgrader comprising:

input means for selecting a desired cross slope angle;

first angle sensor means for sensing the angle of rotation of the blade relative to the steering unit;

second angle sensor means for sensing the angle of rotation of said steering unit relative to the drive unit;

third angle sensor means for sensing the angle of rotation of the front steering wheels relative to the steering unit;

first slope sensor means for sensing the blade slope angle of said blade relative to horizontal;

second slope sensor means for sensing the longitudinal slope angle of the front steering unit relative to horizontal; and cross slope control means connected to said input means, to said first, second and third angle sensor means, and to said first and second slope sensor means for controlling said blade slope angle to maintain said desired cross slope when said motorgrader is being steered through a turn.

14. Apparatus for controlling the cross slope angle of a surface being worked by a motorgrader as claimed in claim 13 wherein said motorgrader further includes an articulation joint connecting said front steering unit to said rear drive unit.

15. Apparatus for controlling the cross slope angle of a surface being worked by a motorgrader as claimed in claim 13, wherein the blade slope angle required to maintain the desired cross slope is calculated by said cross slope control means using the equation:

$$\tan BS = (\sin\tau')(\tan R') + (\cos\tau'')(\tan CS)$$

where BS is the required blade slope angle of said blade relative to horizontal; $\tau''$ is a rotational angle of the blade with respect to the blade's direction of travel projected into horizontal with the lateral slope angle of the front steering unit being set equal to zero; R' is an angle between horizontal and the direction of travel of said blade with the lateral slope angle of the front steering unit being set equal to be zero; and CS is the desired cross slope angle, and said cross slope control means controls said blade slope so that the sensed blade slope angle is substantially equal to the calculated blade slope angle to maintain said desired cross slope when said motorgrader is operated in a crabbed steering position.

16. In a motorgrader having a two-part articulated frame defined by a rear drive unit including rear drive wheels and a front steering unit which can be rotated relative to the drive unit and including front steering wheels, and a blade supported upon the steering unit, the blade being rotatable about a generally vertical axis and being mounted for adjustment of the elevations of the ends of the blade to define a blade slope angle relative to horizontal, a method for controlling the cross slope angle of a surface being worked by the motorgrader comprising the steps of:

selecting a desired cross slope angle;

sensing the angle of rotation of the blade relative to the steering unit;

sensing the angle of rotation of said steering unit relative to the drive unit;

sensing the angle of rotation of said front steering wheels relative to said steering unit;

sensing the blade slope angle of said blade relative to horizontal;

sensing the longitudinal slope angle of the front steering unit relative to horizontal;

sensing the lateral slope angle of the front steering unit relative to horizontal; and controlling said blade slope angle to maintain said desired cross slope when said motorgrader is being steered through a turn.

17. A method for controlling the cross slope angle of a surface being worked by a motorgrader as claimed in claim 16 wherein the step of controlling said blade slope angle to maintain said desired cross slope comprises the steps of calculating a required blade slope angle using the equation:

$$\tan BS = (\sin \tau')(\tan R) + (\cos \tau')(\tan CS)$$

where BS is the required blade slope angle of said blade relative to horizontal; $\tau'$ is a rotational angle of the blade with respect to the blade's direction of travel projected into horizontal; R is an angle between the blade's direction of travel and horizontal; and CS is the desired cross slope angle, and controlling the blade slope so that the sensed blade slope angle is substantially equal to the calculated blade slope angle to maintain said desired cross slope when said motorgrader is operated in a crabbed steering position.

18. A method for controlling the cross slope angle of a surface being worked by a motorgrader as claimed in claim 16 wherein the step of sensing the angle of rotation of said steering unit relative to said drive unit comprises the step of installing an angle sensor at an articulation joint interconnecting said steering unit to said drive unit.

19. A method for controlling the cross slope angle of a surface being worked by a motorgrader as claimed in claim 16 wherein the step of sensing the angle of rotation of said front steering wheels relative to said front steering unit comprises the step of installing an angle sensor adjacent and coupled to said front steering wheels.

20. In a motorgrader having a two-part articulated frame defined by a rear drive unit including rear drive wheels and a front steering unit which can be rotated relative to the drive unit and including front steering wheels, and a blade supported upon the steering unit, the blade being rotatable about a generally vertical axis and being mounted for adjustment of the elevations of the ends of the blade to define a blade slope angle relative to horizontal, a method for controlling the cross slope angle of a surface being worked by the motorgrader comprising the steps of:

selecting a desired cross slope angle;

sensing the angle of rotation of the blade relative to the steering unit;

sensing the angle of rotation of said steering unit relative to the drive unit;

sensing the angle of rotation of said front steering wheels relative to said steering unit;

sensing the blade slope angle of said blade relative to horizontal;

sensing the longitudinal slope angle of the front steering unit relative to horizontal; and controlling said blade slope angle to maintain said desired cross slope when said motorgrader is being steered through a turn.

21. A method for controlling the cross slope angle of a surface being worked by a motorgrader as claimed in claim 20 wherein the step of controlling said blade slope angle to maintain said desired cross slope comprises the steps of calculating a required blade slope angle using the equation:

$$\tan BS = (\sin \tau'')(\tan R') + (\cos \tau'')(\tan CS)$$

where BS is the required blade slope angle of said blade relative to horizontal; $\tau''$ is a rotational angle of the blade with respect to the blade's direction of travel projected into horizontal with the lateral slope angle of the front steering unit being set equal to zero; R' is an angle between horizontal and the direction of travel of said blade with the lateral slope angle of the front steering unit being set equal to zero; and CS is the desired cross slope angle, and controlling the blade slope so that the sensed blade slope angle is substantially equal to the calculated blade slope angle to maintain said desired cross slope when said motorgrader is operated in a crabbed steering position.

* * * * *